United States Patent [19]

Maytum et al.

[11] Patent Number: 4,629,944

[45] Date of Patent: Dec. 16, 1986

[54] STARTER CIRCUIT FOR A FLUORESCENT TUBE LAMP

[75] Inventors: Michael J. Maytum, Bedfordshire; Anthony Lear, Huntingdon; Stephen W. Byatt, Bedford; Richard A. A. Rodrigues, Yealmpton, all of England

[73] Assignee: Texas Instruments Incorporated, Dallas, Tex.

[21] Appl. No.: 584,586

[22] Filed: Feb. 29, 1984

[30] Foreign Application Priority Data

Mar. 3, 1983 [GB] United Kingdom ..... 8305878

[51] Int. Cl.[4] ..... H05B 37/00

[52] U.S. Cl. ..... 315/207; 315/101; 315/103; 315/105

[58] Field of Search ..... 315/101, 102, 103, 105, 315/207

[56] References Cited

U.S. PATENT DOCUMENTS

| | | | |
|---|---|---|---|
| 3,569,776 | 3/1971 | Moerkens et al. | 315/102 |
| 3,643,127 | 2/1972 | Laupman | 315/101 |
| 3,822,409 | 7/1974 | Abe | 331/66 |
| 3,942,070 | 3/1976 | Tomura et al. | 315/101 |
| 3,978,368 | 8/1976 | Tomura et al. | 315/105 |
| 4,227,118 | 10/1980 | Britton | 315/105 |
| 4,380,719 | 4/1983 | DeBijl et al. | 315/101 |

FOREIGN PATENT DOCUMENTS

| | | |
|---|---|---|
| 034401 | 8/1981 | European Pat. Off. . |
| 1254894 | 11/1971 | United Kingdom . |
| 1264397 | 2/1972 | United Kingdom . |
| 1278839 | 6/1972 | United Kingdom . |
| 1303337 | 1/1973 | United Kingdom . |
| 1369962 | 10/1974 | United Kingdom . |
| 2023951 | 1/1980 | United Kingdom . |
| 1566540 | 4/1980 | United Kingdom . |
| 1602456 | 11/1981 | United Kingdom . |
| 2101820 | 1/1983 | United Kingdom . |

*Primary Examiner*—Harold Dixon

*Attorney, Agent, or Firm*—John A. Haug; James P. McAndrews; Melvin Sharp

[57] ABSTRACT

A starter circuit for a fluorescent tube lamp is connected between the cathode heaters of the tube to provide an initial heating current and then changes to a high impedance to ignite the tube. The circuit is fed by raw rectified a.c. and has a main thyristor requiring a high holding current to maintain the initial conduction. The current through the main thyristor sets up a voltage across a series diode which triggers a second thyristor to reduce the gate voltage of the main thyristor. The main thyristor ceases conduction when the current falls below the holding value and the inductive ballast impedance then produces a high energy striking pulse for the tube. The pulse voltage is limited to increase its duration. One embodiment generates a single pulse only each time the circuit is switched on and another embodiment produces pulses for a period of time before becoming quiescent. The main thyristor and the voltage limiting means are embodied in a monolithic semiconductor structure.

12 Claims, 2 Drawing Figures

STARTER CIRCUIT FOR A FLUORESCENT TUBE LAMP

This invention relates to starter circuits for fluorescent tube lamps.

Fluorescent tubes are lamps which produce light by means of an electrical discharge in a gas which excites a phosphor coating on the tube. When in operation, the impedance of the tube is negative and therefore requires an added series impedance so that the operation is stable. For AC circuits the series impedance is usually chosen to be reactive so as to reduce power losses.

Once the tube has been struck the "running" voltage is between 20 and 60 percent of the nominal AC supply voltage, the remainder of that voltage being dropped across the added series impedance. The purpose of a starting circuit is to strike the discharge in the tube and the voltage required to achieve this is higher than the running voltage and depends on the age of the tube, its operational environment and the length of time for which striking voltage is applied. Tubes have heated cathodes which provide a source of ions and electrons for the discharge and reduce the magnitude of the voltage required to strike the tube. It is possible to strike a tube when the cathodes are cold but the striking voltage/time requirement is usually beyond the capability of conventional starting circuits; and, in any case, the cold striking of a tube tends to shorten its life and because of the high voltages required for the larger tube sizes is not normally used for such tubes. It is therefore a function of starting circuits to provide a period of which current is applied to the cathodes to heat them and a well-known circuit for achieving this includes a glow tube switch which is used to complete a series circuit including the ballast series impedance and the two cathode heaters, the switch itself being connected between the two cathode heaters. When power is first supplied to the circuit, the full AC supply voltage is applied to the glow tube in which a discharge is set up and the heat of this discharge heats up a bimetallic strip. When sufficiently hot, this strip closes some switch contacts which short-circuit the glow tube and cause the cathode heaters to be heated by the supply current. After a certain period of time the bimetallic strip cools allowing the switch to open again which interrupts the heater current and causes the ballast impedance, which is usually an inductor, to produce an e.m.f. in addition to the supply voltage which is usually sufficient to strike the tube. If the tube does not strike, the glow tube switch will repeat its attempt to strike it as described above.

The main problems with the glow tube switch as described above are that the actual time of opening of the switch is random relative to the supply voltage so that the actual e.m.f. applied to the tube in an attempt to strike it is frequently insufficient so that the striking of the tube is delayed and it is preceded by an unpleasant series of flashes. Furthermore, the performances of the glow tube starters are very variable which can result in unreliable operation in some instances. In addition, the life expectancy of the glow tube switch is unpredictable. Moreover, the continued attempts to strike a faulty tube by such a switch can be very annoying.

In order to overcome the above disadvantages of a glow tube starter switch certain semiconductor solutions have been proposed, but in many instances the circuits are quite complicated so that the switch cannot be manufactured as cheaply as a glow tube switch and cannot be fitted into the small cylindrical package used for such switches so that they cannot be regarded as an in-service replacement for the glow tube switch.

It is an object of the present invention to provide an improved form of electronic circuit for starting a fluorescent tube lamp which overcomes the disadvantages of the glow tube switch and many of the disadvantages of the semiconductor replacements for the glow tube switch.

According to the present invention there is provided a starter circuit for an a.c. energised fluorescent tube lamp having cathodes with heaters and an inductive ballast impedance in which in use the circuit is connected between the cathode heaters of the tube itself and presents a low impedance enabling the heaters to be energised during part of the starting procedure and a high impedance whilst the tube is running, the circuit including a thyristor having a controlled current path for connection between the cathode heaters and the transition from low impedance to high impedance of that path occurs when the cyclically varying current through the controlled path falls below the holding current of the thyristor, wherein the thyristor is so constructed as to require a high holding current and the circuit is such that in use the inductive ballast impedance stores energy corresponding substantially to the passage of the high holding current through it at the instant of the transition from low impedance to high impedance so that the energy is converted to a high voltage striking pulse which is applied to the tube.

The starter circuit may include voltage limiting means connected in parallel with the controlled current path of the thyristor to restrict the amplitude of the voltage pulse from the inductive ballast impedance and thereby extend its duration. The thyristor and the voltage limiting means may be embodied in a monolithic power semiconductor structure. Since the amount of energy stored in the inductive ballast impedance at the instant of the transition from low impedance to high impedance of the controlled current path is fixed by the holding current of the thyristor and the inductance of the impedance, and the voltage of the supply at that instant is predetermined, it follows that the use of the voltage limiting means will result in a pulse of known amplitude and duration being applied to the tube. Preferably the parameters determining the amplitude and duration of the pulse are chosen to suit the starting conditions required by the tube.

In order to provide for the heating of the cathodes the thyristor needs to be held in the low impedance condition for a period of preheating appropriate to the tube. This can be achieved by providing a resistive connection from the anode of the thyristor to its gate to hold it in conduction and then short-circuiting the gate to the cathode of the thyristor or otherwise holding the gate bias sufficiently negative at the end of the preheating period so that the thyristor switches to the high impedance condition when the current next falls below the holding value. The duration of the preheating period may be made inversely dependent on the preheating current so that the same starting circuit is suitable for different sizes of tube.

The circuit may be arranged to produce only a single striking pulse before it becomes quiescent or it may produce striking pulses for a predetermined period and then become quiescent.

Preferably the circuit includes a diode bridge rectifier circuit so that the conductive state of the thyristor can control the current in both phases of the a.c. supply. Alternatively a single diode half wave rectifier may be used provided that adequate power can be applied to the cathode heaters when the thyristor is conducting.

In order that the invention may be fully understood and readily carried into effect, it will now be described with reference to the accompanying drawings, of which:

Figure 1:
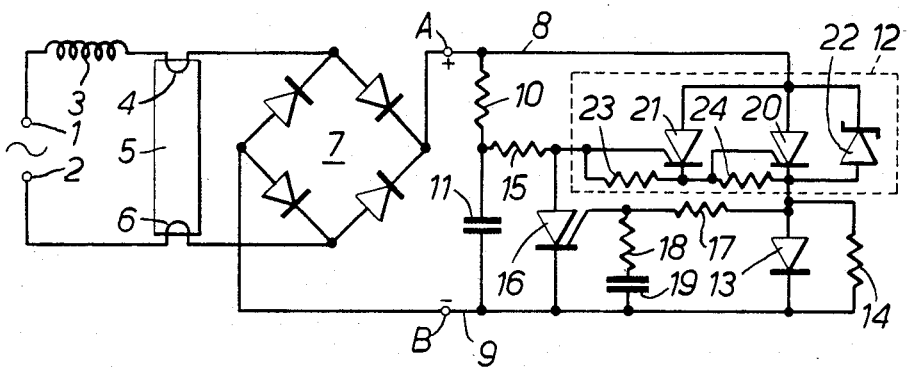
FIG. 1 is a diagram of one example of a starter circuit.

Referring now to FIG. 1, a.c. supply terminals 1 and 2 are provided of which the terminal 1 is connected through a ballast choke 3 to one end of a cathode heater winding 4 of a fluorescent tube lamp 5. The terminal 2 is connected directly to an end terminal of the heater 6 of a second cathode of the tube 5. The other ends of the heaters 4 and 6 are connected across a diagonal of a diode bridge rectifier 7 of which the output diagonal is connected to a positive conductor 8 and a negative conductor 9. The positive conductor 8 is connected to the negative conductor 9 through two parallel circuits. In one of these parallel circuits a resistor 10 and a capacitor 11 are connected in series and in the other parallel circuit a "fluoractor" 12 is connected in series with a diode 13 and a resistor 14 connected in parallel with one another. The junction of the resistor 10 and the capacitor 11 is connected via a resistor 15 to the gate or control electrode of the fluoractor 12, which electrode is connected through a thyristor 16 to the negative conductor 9. The junction of the fluoractor 12 and the diode 13 is connected through a resistor 17 to the gate of the thyristor 16 which electrode is connected to the negative conductor 9 through a series circuit consisting of a resistor 18 and a capacitor 19.

The fluoractor 12 is a monolithic power semiconductor structure which includes a main thyristor 20 and an auxiliary thyristor 21 with their anodes connected together. The cathode of the auxiliary thyristor 21 is connected to the gate of the main thyristor 20 and the gate of the auxiliary thyristor 21 acts as the gate of the fluoractor. A zener diode or other voltage limiting structure 22 is provided in parallel with the anode-cathode path of the main thyristor 20 which forms the controlled current path of the fluoractor 12. The auxiliary thyristor 21 is of conventional thyristor construction and has in effect a resistor 23 of 1 kΩ connected between gate and cathode. The main thyristor 20 has a modified construction with a number of shorting dots shorting the gate to cathode junction, the effect of which is to cause the thyristor 20 to require a particularly high current to hold it in conduction when there is no positive bias on the gate. Another effect of the shorting dots is to produce the effect that the gate is effectively shorted to the cathode of this thyristor through a resistance 24 of about 30Ω. Other effects are produced by the structure and these will be described where appropriate in the description of the operation of the circuit.

The starter circuit consists of the components shown in FIG. 1 to the right of the tube 5 and these would be included in a small cylindrical package such as that used for a conventional glow switch starter and it is intended that they would be directly replaceable items for a glow switch starter.

In the operation of FIG. 1, when the a.c. supply is first connected to the terminals 1 and 2, a relatively small current flows establishing a positive potential on the conductor 8 relative to the conductor 9. Current then flows through the resistor 10 and within a fraction of a second the capacitor 11 is charged to a voltage sufficient to switch the fluoractor 12 into conduction. Once the fluoractor 12 is conducting a relatively large current can flow in both ½ cycles of the a.c. supply by virtue of the diode bridge 7 so that the heaters 4 and 6 of the cathodes of the tube 5 are heated up. During this time the current is effectively controlled by the impedance of the ballast choke 3 and the resistances of the heaters 4 and 6.

As with a conventional glow switch starter, when the heaters have been energised for a sufficient period of time for them to have reached the correct temperature for the tube to be struck, the starting circuit switches to a high impedance. This is achieved in the circuit shown in FIG. 1 by the flow of current through the resistors 17 and 18 which causes the capacitor 19 to be charged up. When the preheating period for the cathodes expires the amount of charge on the capacitor 19 is sufficient to permit the junction of resistors 17 and 18 to have reached a voltage high enough to cause the thyristor 16 to become conducting, thus bringing the potential applied to the gate of the fluoractor 13 down to a voltage close to that of the negative conductor 9. Because the alternating supply is rectified by the diode bridge 7 but is not subjected to any significant smoothing, there is quite a large 100 Hz ripple superimposed on the d.c. supply with the result that the voltage which appears at the junction of the resistors 17 and 18 also contains a significant 100 Hz ripple which ensures that the time of firing of the thyristor 16 occurs near a voltage peak of the a.c. supply. The fluoractor 12 remains conducting as long as the current through it exceeds the holding current of the main thyristor 20. However, the current through the fluoractor 12 which is substantially in phase with the voltage across it follows a succession of half sine waves resulting from the full wave rectification of the a.c. supply. This means that near each zero crossing of the a.c. supply waveform the current through the fluoractor 12 will fall below the holding current and the fluoractor will then cease to conduct. At this time the energy stored in the ballast choke 3 appears as a high voltage pulse because the current has been reduced substantially to zero. The voltage of this pulse is limited by the zener diode 22 built into the fluoractor 12 which permits such current to flow as to hold the voltage at a clamped value determined by the structure of the zener diode 22. Because all of the energy in the choke 3 must appear in the high voltage pulse, it follows that the duration of this pulse will be extended and it can be shown that the duration of the pulse is approximately equal to $$L.I._H/(V_{clamp}+V_{supply})$$

where

L is the inductance of the choke 3

$I_H$ is the holding current of the fluoractor 12

$V_{clamp}$ is the limiting voltage of the zener diode 22 and $V_{supply}$ is the supply voltage at the particular instant.

The above expression is approximately valid for a lagging power factor circuit; for a leading power factor circuit the expression is modified by a change of the positive sign to a negative one in the denominator so that the duration of the pulse is longer. The voltage $V_{clamp}$ is that which is available to strike the tube, it being applied across the two cathodes of the tube.

The above description of the operation of the circuit of FIG. 1 has been simplified to some extent since the structure of the fluoractor 12 results in an appreciable current flowing out of the gate connection whilst the device is conducting, and this current helps to charge the capacitor 11. Although it would appear that the voltage set up across the diode 13 would be insufficient to trigger the thyristor 16, it should be remembered that in operation a considerable current is flowing through the diode 13 so that the voltage established across it is approximately 0.9 volts which is rather larger than the 0.5 volts which is due to the junction itself. In a typical example of the circuit of FIG. 1, the following component types were used.

Component No. 7: 1N400×
Component No. 10: 150k
Component No. 11: 10 μF
Component No. 13: 1N4001
Component No. 14: 3k9Ω
Component No. 15: 330Ω
Component No. 16: TICP106
Component No. 17: 33kΩ
Component No. 18: 3k9Ω
Component No. 19: 47 μF The circuit of FIG. 1 produces only a single striking pulse because once the thyristor 16 has been triggered into conduction, it remains conducting because sufficient current flows through the resistors 10 and 15 to keep in that condition and therefore the voltage applied to the gate of the fluoractor 12 remains too negative to permit it to conduct. If the striking pulse is not effective in striking the tube the a.c. power may be switched off and reapplied for a second attempt. There is no appreciable delay in the termination of the conduction of the thyristor 16 once the a.c. supply is switched off, because the charge in the capacitor 11 is rapidly reduced through the relatively low resistor 15 and the thyristor 16.

Figure 2:
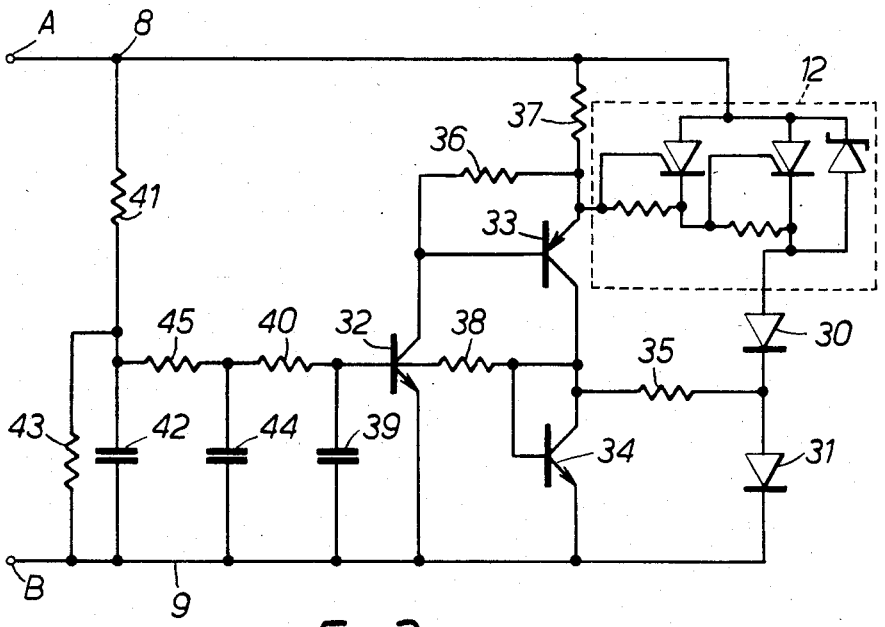
FIG. 2 is a diagram of another starter circuit.

FIG. 2 shows an alternative circuit which produces a plurality of striking pulses over a controlled period after which the circuit becomes quiescent. Components of FIG. 2 which correspond exactly to those of FIG. 1 have the same reference numbers as in that Figure. The terminals A and B of FIG. 2 correspond to those marked on the conductors 8 and 9 in FIG. 1, the remainder of the circuit to the left of those terminals being exactly as shown in FIG. 1.

In FIG. 2, the controlled current path of the fluoractor 12 is connected from the positive conductor 8 through diodes 30 and 31 in series to the negative conductor 9. Transistors 32 and 33 are connected in a regenerative feedback circuit to act as a thyristor but the collector load of the transistor 33 takes the form of a diode-connected transistor 34 connected between the collector of the transistor 33 and the conductor 9. The collector of the transistor 33 is connected to the junction of the diodes 30 and 31 through a resistor 35. The base of the transistor 33 is connected to its emitter through a resistor 36 and that emitter is connected directly to the gate of the fluoractor 12 and through a resistor 37 to the conductor 8. With regard to the transistor 32, its collector is connected directly to the base of the transistor 33, its emitter is connected directly to the conductor 9 and its base is connected through a resistor 38 to the collector of the transistor 33, to the conductor 9 through a capacitor 39 and to one end of a resistor 40. A resistor 41 and a capacitor 42 are connected in series from the conductor 8 to the conductor 9. The capacitor 42 is shunted by a resistor 43. The junction of the resistor 41 and the capacitor 42 is connected through a resistor 45 to the other end of the resistor 40 and the junction of these two resistors is connected to the conductor 9 through a capacitor 44.

The values of component types of the components used in FIG. 2 in one example are as follows:

Component No. 30,31: 1N4007
Component No. 32: BC184
Component No. 33: BC212
Component No. 34: BC184
Component No. 35: 220Ω
Component No. 36: 1k5Ω
Component No. 37: 150kΩ
Component No. 38: 680Ω
Component No. 39: 1n5F
Component No. 40: 33kΩ
Component No. 41: 100kΩ
Component No. 42: 220 μF
Component No. 43: 10kΩ
Component No. 44: 47 μF
Component No. 45: 29kΩ

In the operation of FIG. 2, when a.c. power is first applied and a d.c. voltage is established between conductors 8 and 9, current flows through the resistor 37 applying a positive voltage to the gate of the fluoractor 12 which then becomes conducting so that a low impedance is presented between the conductors 8 and 9. In this condition, the preheating current is applied to the heaters of the cathodes of the tube. The current through the fluoractor 12 establishes about 0.9 volts across the diode 31 so that current flows through resistors 35, 38 and 40 to charge the capacitor 44. The size of the capacitor 39 is so much smaller than that of the capacitor 44 that it can be ignored during consideration of this part of the operation of the circuit; the capacitor 39 is provided to absorb spurious noise pulses which might otherwise trigger the thyristor formed by the transistors 32 and 33. Up to this time the transistors 32 and 33 have been non-conducting, but when the voltage at the base of the transistor 32 reaches about 0.7 volts the transistors 32 and 33 become conducting with the result that the gate of the fluoractor 12 is taken to a more negative value so that the fluoractor becomes non-conducting when the current through it falls below its relatively high holding current. Because the d.c. supply applied to the circuit is unsmoothed full wave rectified a.c., there is a substantial 100 Hz ripple on the d.c. which also appears on the voltage applied to the base of the transistor 32 so that the actual start of conduction of the thyristor formed by the transistors 32 and 33 occurs during that part of the 100 Hz cycle at which the voltage is its most positive. Therefore the actual timing of the switching off of the fluoractor 12 which is determined by the time at which the current through it falls below the required holding current depends to a very large exrent on the timing of the charging of the capacitor 44 from the voltage established across the diode 31. Thus the preheat time of the cathode heaters of the tube is closely controlled and need not depart substantially from an ideal value. Up to now the operation of the circuit of FIG. 2 has been similar to that of FIG. 1. However, in FIG. 2 the gain of the thyristor circuit formed by the transistors 32 and 33 is deliberately restricted by the use of the diode-connected transistor 34 as the collector load of the transistor 33 so that it like the fluoractor 12 requires a relatively high current to hold it in conduction, although its holding current is much lower than that of fluoractor 12. Thus shortly after the fluoractor 12 has ceased conduction so the thyristor formed by the transistors 32 and 33 also ceases conduction. As a result of this action the conductive states of the fluoractor 12 and the thyristor formed by the transistors 32 and 33 are the same as they were initially and the generation of a striking pulse can recur. Of course, the period of time necessary to build up an adequate voltage at the base of the transistor 32 to cause the thyristor formed by the transistors 32 and 33 to start conducting again is shorter than it was initially because of the residual charge stored in the capacitor 44, but as the cathodes of the tube are already heated, it is not necessary for current to be fed through the cathode heaters for the full reheat period between its striking pulses.

The structure of the fluoractor is such that whilst it is conducting and also whilst it is clamping the voltage being applied across it, current flows out of the gate connection and this current flows through the thyristor formed by the transistors 32 and 33 to charge up not only the capacitor 44 but also the capacitor 42. Therefore, during each striking pulse the charge stored in the capacitor 42 is increased with the result that if the tube fails to strike after a few seconds sufficient charge will have been accumulated by the capacitor 42 for the voltage at the base of the transistor 32 to be high enough to hold the thyristor formed by the transistors 32 and 33 in conduction whenever a positive voltage appears at the emitter of the transistor 33. This means that the fluoractor 12 does not become conducting and the circuit assumes a quiescent state in which the charge on the capacitor 42 is sustained by current flow through the resistor 41 and the thyristor formed by the transistors 32 and 33 is continuously conducting.

Among the advantages of a starter circuits described are the fact that the timing of the pre-heat current can be quite precisely controlled so that the tube cathodes reach the optimum temperature for striking the tube and that the voltage clamping action of the fluoractor serves not only to limit the voltage stresses on the components of the circuit but also to extend the duration of the striking pulse applied to the tube which has been found to make the striking of the tube more reliable than with a shorter pulse. In order to make a starter circuit better suited to a range of tube sizes the voltage set up across the diode (13 of FIG. 1 or 31 of FIG. 2) from which the firing voltage for the thyristor (16 of FIG. 1 or 32,33 of FIG. 2) is built up may be arranged to be dependent on the magnitude of the cathode heater current by including a resistor in series with the diode. In addition, the energy in the striking pulse is accurately controlled because of the way in which it is generated.

Although the circuits described have used a full wave rectifier circuit, half wave rectification could be used instead, allowance being made for the effectively smaller heater current and the intervals between the rectified current pulses.

What we claim is:

1. A starter circuit for an a.c. energized fluorescent tube lamp having cathode with heaters and an inductive ballast impedance in which in use the circuit is connected between the cathode heaters of the tube itself and presents a low impedance enabling the heaters to be energized during part of the starting procedure and a high impedance whilst the tube is running, the circuit including a thyristor having a gate and having an anode and a cathode forming a controlled current path for connection between the cathode heaters and the transition from low impedance to high impedance of that path occurs when the cyclically varying current through the controlled path falls below the holding current of the thyristor, wherein the thyristor is so constructed as to have a low resistance connected between its gate and its cathode so as to require a high holding current and the circuit is such that in use the inductive ballast impedance stores energy corresponding substantially to the passage of the high holding current through it at the instant of the transition from low impedance to high impedance so that the energy is converted to a high voltage striking pulse which is applied to the tube and voltage limiting means being connected in parallel with the controlled current path of the thyristor to restrict the voltage of the pulse generated by the inductive ballast impedance and thereby extend the duration of the pulse.

2. A circuit according to claim 1 including a full wave rectifier for connecting the cathode heaters of the tube to the controlled current path of the thyristor.

3. A circuit according to claim 1 including a half wave rectifier for connecting the cathode heaters of the tube to the controlled current path of the thyristor.

4. A circuit according to claim 1 wherein the voltage limiting means is a zener diode.

5. A circuit according to claim 1 wherein the voltage and duration of the pulses is chosen to provide optimum striking conditions for a particular fluorescent tube lamp.

6. A circuit according to claim 1 wherein the thyristor and the voltage limiting means are embodied in a monolithic power semiconductor structure.

7. A circuit according to claim 6 wherein the semiconductor structure also includes a second thyristor having a gate and having an anode and a cathode forming a controlled current path, the controlled current path connected from the anode to the gate of the first-mentioned thyristor which is switched to its low impedance state by a positive voltage applied to the gate of the second thyristor.

8. A circuit according to claim 7 including a resistor connected from the anode of the thyristor to the gate of the second thyristor for switching the first-mentioned thyristor to its low impedance state when the circuit is initially energised, and means for holding the gate of the second thyristor at such a voltage that the first-mentioned thyristor switches to its high impedance state when the current through it falls below the holding value at the end of a time period for preheating the cathode heaters of the tube.

9. A circuit according to claim 8 wherein the holding means includes a further thyristor having a gate and having an anode and a cathode forming a controlled current path of which the controlled current path is connected from the gate of the second thyristor to a point maintained at a zero or negative voltage relative to the cathode of the first-mentioned thyristor, the gate of the further thyristor being connected to means in the controlled current path of the first-mentioned thyristor for switching the further thyristor to its low impedance state at the end of the time period for preheating the cathode heaters of the tube.

10. A circuit according to claim 1 wherein the interval of time between energisation of the circuit and the first (or only) transition from low impedance to high impedance of the controlled current path of the first-mentioned thyristor is inversely dependent on the magnitude of the current through that controlled current path.

11. A starter circuit for an a.c. energized fluorescent tube lamp having cathode with heaters and an inductive ballast impedance in which in use the circuit is connected between the cathode heaters of the tube itself and presents a low impedance enabling the heaters to be energized during part of the starting procedure and a high impedance whilst the tube is running, the circuit including a thyristor having a gate and having an anode and a cathode forming a controlled current path for connection between the cathode heaters and the transition from low impedance to high impedance of that path occurs when the cyclically varying current through the controlled path falls below the holding current of the thyristor, a resistor connected from the anode of thyristor to its gate for switching the thyristor to its low impedance state when the circuit is initially energized, and means for holding the gate of the thyristor at such a voltage that the thyristor switches to its high impedance state when the current through it falls below the holding value at the end of a time period for preheating the cathode heaters of the tube wherein the thyristor is so constructed as to have a low resistance connected between its gate and its cathode so as to require a high holding current and the circuit is such that in use the inductive ballast impedance stores energy corresponding substantially to the passage of the high holding current through it at the instant of the transition from low impedance to high impedance so that the energy is converted to a high voltage striking pulse which is applied to the tube, the holding means including a further thyristor having a gate and having an anode and a cathode forming a controlled current path of of which the controlled current path is connected from the gate of the first-mentioned thyristor to a point maintained at a zero or negative voltage relative to the cathode of the first-mentioned thyristor, the gate of the further thyristor being connected to means in the controlled current path of the first-metioned thyristor for switching the further thyristor to its low impedance state at the end of the time period for preheating the cathode heaters of the tube, the holding means is such that once the further thyristor becomes low impedance it remains conducting until the supply to the circuit is terminated.

12. A starter circuit for an a.c. energized flourescent tube lamp having cathode with heaters and an inductive ballast impedance in which in use the circuit is connected between the cathode heaters of the tube itself and presents a low impedance enabling the heaters to be energized during part of the starting procedure and a high impedance whilst the tube is running, the circuit including a thyristor having a gate and having an anode and a cathode forming a controlled current path for connection between the cathode heaters and the transition from low impedance to high impedance of that path occurs when the cyclically varying current through the controlled path falls below the holding current of the thyristor, a resistor connected from the anode of thyristor to its gate for switching the thyristor to its low impedance state when the circuit is initially energized, and means for holding the gate of the thyristor at such a voltage that the thyristor switches to its high impedance state when the current through it falls below the holding value at the end of a time period for preheating the cathode heaters of the tube wherein the thyristor is so constructed as to have a low resistance connected between its gate and its cathode so as to require a high holding current and the circuit is such that in use the inductive ballast impedance stores energy corresponding substantially to the passage of the high holding current through it at the instant of the transition from low impedance to high impedance so that the energy is converted to a high voltage striking pulse which is applied to the tube, the holding means includes a further thyristor having a gate and having an anode and a cathode forming a controlled current path of which the controlled current path is connected from the gate of the first-mentioned thyristor to a point maintained at a zero or negative voltage relative to the cathode of the first-mentioned thyristor, the gate of the further thyristor being connected to means in the controlled current path of the first-mentioned thyristor for switching the further thyristor to its low impedance state at the end of the time period for preheating the cathode heaters of the tube, the holding means is such that the further thyristor is switched to its high impedance state shortly after the first-mentioned thyristor becomes non-conducting, the further thyristor being repeatedly switched between low impedance and then high for a predetermined period of time at the end of which it remains low impedance.

* * * * *